US009207580B2

(12) United States Patent
Janssen

(10) Patent No.: US 9,207,580 B2
(45) Date of Patent: Dec. 8, 2015

(54) TONER REFILL DEVICE

(71) Applicant: OCE-TECHNOLOGIES B.V., Venlo (NL)

(72) Inventor: Willem P. H. A. Janssen, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/256,794

(22) Filed: Apr. 18, 2014

(65) Prior Publication Data

US 2014/0227008 A1 Aug. 14, 2014

Related U.S. Application Data

(63) Continuation of application No. PCT/EP2012/069915, filed on Oct. 9, 2012.

(30) Foreign Application Priority Data

Oct. 19, 2011 (EP) ..... 11185718

(51) Int. Cl.
*G03G 15/08* (2006.01)

(52) U.S. Cl.
CPC ..... *G03G 15/0894* (2013.01); *G03G 15/087* (2013.01); *G03G 15/0886* (2013.01)

(58) Field of Classification Search
CPC ..... G03G 15/0894; G03G 15/0836; G03G 15/0867; G03G 15/087; G03G 2215/0673; G03G 2215/0663
USPC ..... 399/258, 262
See application file for complete search history.

(56) References Cited

U.S. PATENT DOCUMENTS 4,304,273 A * 12/1981 Caudill et al. ..... 141/268
6,463,243 B1 10/2002 Boogert et al.

FOREIGN PATENT DOCUMENTS

EP 0 701 181 A2 3/1996
EP 1 209 537 A2 5/2002
JP 60-154272 A 8/1985

OTHER PUBLICATIONS

Form PCT/ISA/237 (Jul. 2009); Written Opinion of the International Searching Authority.

* cited by examiner

*Primary Examiner* — Erika J Villaluna
(74) *Attorney, Agent, or Firm* — Birch, Stewart, Kolasch & Birch, LLP

(57) ABSTRACT

A toner refill device includes first and second adapter units defining first and second refill openings, and first and second closure members movable between closed positions open and closed positions to respectively close and open the refill openings. The second closure member has a passage forming element connecting the refill openings when the second closure member is in the open position. The second adapter unit defines an accommodation space for accommodating the passage forming element when the second closure member is in the closed position. The closure members are adapted to be coupled to one another for a joint movement relative to the adapter units. The closure members are rotatably supported in their respective adapter units so as to be jointly rotatable about a common axis of rotation. The second refill opening and the accommodation space are angularly offset from one another about said common axis of rotation.

12 Claims, 6 Drawing Sheets

TONER REFILL DEVICE

CROSS-REFERENCE TO RELATED APPLICATIONS

This application is a Continuation of International Application No. PCT/EP2012/069915, filed on Oct. 9, 2012, and for which priority is claimed under 35 U.S.C. §120. PCT/EP2012/069915 claims priority under 35 U.S.C. §119(a) to Application No. 11185718.1, filed in Europe on Oct. 19, 2011. The entire contents of each of the above-identified applications are hereby incorporated by reference into the present application.

BACKGROUND OF THE INVENTION

1. Field of the Invention

The present invention relates to a toner refill device comprising: a first adapter unit defining a first refill opening; a first closure member attached to the first adapter unit and movable between a closed position in which it closes the first refill opening, and a second position; a second adapter unit defining a second refill opening; and a second closure member attached to the second adapter unit and movable between a closed position in which it closes the second refill opening, and an open position, said second closure member having a passage forming element that connects the first and second refill openings when the second closure member is in the open position, wherein the second adapter unit defines an accommodation space for accommodating the passage forming element when the second closure member is in the closed position, and wherein the first and second closure members are adapted to be coupled to one another for a joint movement relative to the first and second adapter units.

2. Description of Background Art

Toner refill devices are used for refilling toner powder in copying or printing machines. Since the toner powder is very fine and easily dispersed, the refill device should be designed such that it prevents objects in environment and/or the hands of a user using the refill device from becoming stained with toner powder.

U.S. Pat. No. 6,463,243 B1 discloses a toner refill device of the type described above. The first adapter unit is permanently attached to a toner bottle, whereas the second adapter unit is permanently attached to a toner reservoir of the printer or copier. In order to refill toner from the bottle into the toner reservoir, the bottle is placed in an inverted position on top of the second adapter unit, so that the two adapter units can be coupled to one another. Then, the closure members are jointly moved into their respective open positions, whereby the passage forming element is brought into a position in which it connects the first and second refill openings, so that toner powder may drop from the bottle into the toner reservoir under the action of gravity. Inevitably, the internal walls of the passage forming element become stained with toner powder in this process. However, when the closure members are moved back into the closed position, the passage forming element will be moved into the accommodating space which then shields the environment against the toner powder that adheres to the walls of the passage forming element. Thus, the risk of polluting the environment can largely be eliminated.

In the known device, the second closure member and the passage forming element are configured as a drawer that is linearly slideable in the second adapter unit. In an inactive position, the closure member closes the second refill opening, and the passage forming element is accommodated in the accommodating space in a position laterally offset from the second refill opening. When the drawer is slid into a refill position, the passage forming element is brought into a position in which it is flush with the second refill opening, whereas the closure member assumes a laterally offset position on the side of the second refill opening opposite to the accommodation space.

SUMMARY OF THE INVENTION

It is an object of the present invention to provide a toner refill device that has a more compact construction. In order to achieve this object, according to the present invention, the toner refill device of the type indicated above includes the first and second closure members being rotatably supported in their respective adapter units so as to be jointly rotatable about a common axis of rotation, and the second refill opening and the accommodation space are angularly offset from one another about said common axis of rotation.

Thus, the closure members and the passage forming element perform a rotary movement rather than a linear movement. In the conventional device, where they perform a linear movement, the overall dimension of the device in the pull-out direction of the drawer has to be at least three times the dimension of the second refill opening in that direction. In contrast, in the present invention, the second refill opening, the accommodation space for the passage forming element and a third space for accommodating the closure member in the open position may be arranged in three different sectors of a circle, so that the dimension of the device will essentially correspond to the diameter of that circle and does not have to be larger than approximately twice the dimension of the refill opening. As a result, for a given cross-sectional area of the refill opening or openings, the space requirement for the refill device can be reduced significantly.

According to an embodiment of the present invention, each of the first and second adapter units has two refill openings that are angularly offset from one another by 180°, so that the arrangement is symmetric with respect to the axis of rotation.

In a further embodiment, the first adapter unit is arranged to be coupled to the second adapter unit such that they are prevented from rotation relative to one another, while their closure members are coupled for joint rotation.

In another embodiment, a motor drive unit is provided for effecting the joint rotation of the closure members. This has the advantage that the rotation speed can be controlled such that the frictional heat at the sliding surfaces of the closure members is limited to a value where the toner powder does not yet tend to cake.

One of the adapter units, e.g. the second adapter unit, may be connected to the toner reservoir of the printer or copier via elastic fixtures and an elastic joint, and a wobbling device may be provided for wobbling the entire assembly formed by the coupled first and second adapter units and the toner bottle so as to promote the discharge of toner powder from the bottle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
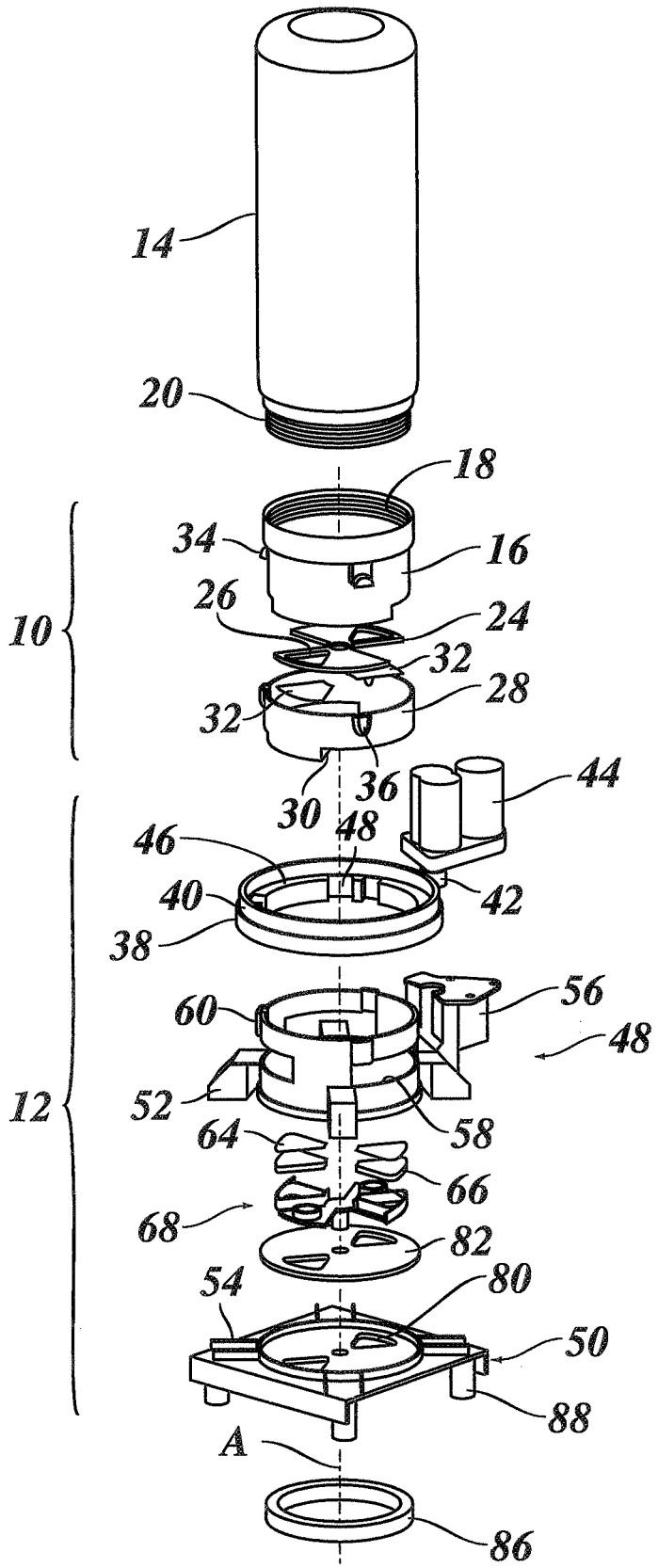
FIG. 1 is a perspective exploded view of a toner refill device according to the present invention.

The present invention will now be described with reference to the accompanying drawings, wherein the same or similar elements are identified with the same reference numerals throughout the several views.

Figure 2:
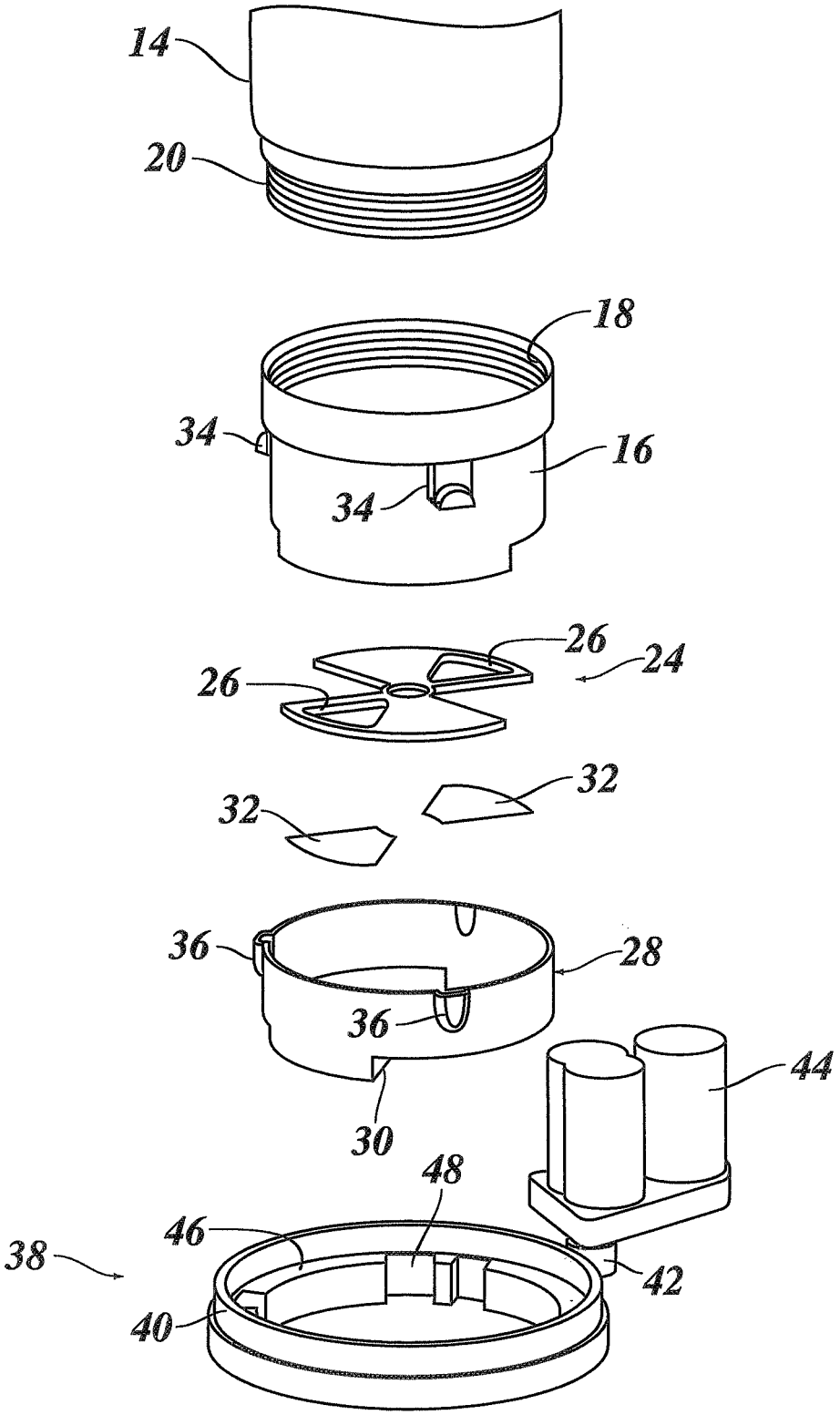
FIGS. 2 and 3 are enlarged views of parts of the device shown in FIG. 1.

The toner refill device shown in FIG. 1 comprises a first adapter unit 10 and a second adapter unit 12 that are configured to be coupled to one another. The first adapter unit 10, which has been shown on an enlarged scale in FIG. 2, is to be attached to an open end of a toner bottle 14 and has a tubular body or cap member 16 with an internal screw-thread 18 for being threaded onto an external screw-thread 20 formed on a neck of the toner bottle 14.

At the bottom end, the cap member 16 has a bottom wall 21 (FIG. 5), which defines a first refill opening 22. A seal plate 24, which may be made of an elastic foam material, is attached to a bottom face of the cap member 16. A circular area covered by the seal 24 plate is divided into six equi-angular sectors. Two of these sectors that are diametrically opposite to one another have been cut-out from the seal plate, and two other sectors which are also opposite to one another are formed with openings 26 which, together, define a butterfly-shaped open area that is congruent with the first refill opening 22 in the cap member 16.

The first adapter unit 10 further comprises a sleeve-like first closure member 28 that surrounds a lower end portion of the tubular cap member 16. The first closure member 28 is rotatable on the cap member 16 and is axially held in position thereon by inter-engaging locking cams and grooves that are not visible in FIG. 1. The circular footprint of the first closure member 28 is also subdivided into six equi-angular sectors, and a bottom wall 30 is formed only in two of these sectors that are diametrically opposite to one another. A slide foil 32 is placed on the top face of each sector of the bottom wall 30. In the sectors having the bottom wall 30, the height of the first closure member 28 is increased, so that the wall portions interconnected by the bottom wall 30 project downwardly.

The outer peripheral surface of the cap member 16 is formed with three cams 34 arranged in angular intervals of 120°, and the outer peripheral surface of the first closure member 28 is formed with three cams 36 in corresponding angular positions. Alternatively, any other distribution of the cams can be used to obtain a keying functionality to mechanically distinguish several types of toner bottles.

The second adapter unit 12 comprises a drive ring 38 having a top part that is configured as an externally toothed gear 40 meshing with a pinion 42 that is driven by a motor drive unit 44. The lower part of the drive ring 38 forms an inwardly projecting boss 46, the internal peripheral wall of which is formed with vertical grooves 48 that can accommodate the cams 36 of the first closure member 28.

Figure 3:
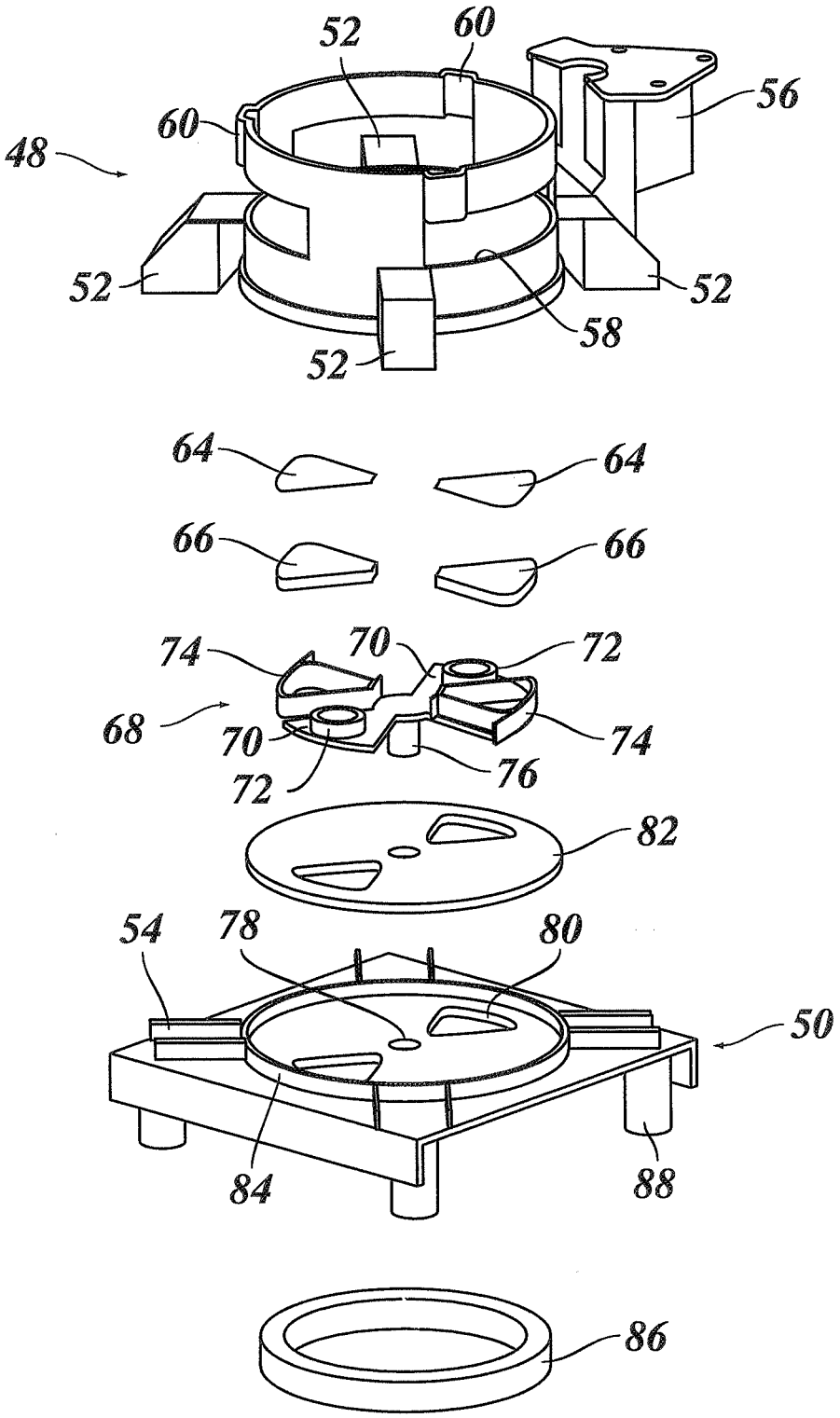

The second adapter unit 12, most parts of which are shown on an enlarged scale in FIG. 3, further comprises a tubular casing 48 and a square base plate 50. Four mounting lugs 52 project from the outer peripheral surface of the casing 48 at the bottom end thereof and are accommodated in mounting sockets 54 formed on the top surface of the base plate 50 in the four corners thereof. Each mounting lug 52 accommodates a fastening screw (not shown), with which the casing 48 is firmly secured to the base plate 50.

The casing 48 is further formed with a radially and upwardly projecting mounting socket 56 for the motor drive unit 44. The tubular body of the casing 48 is divided into a top part and a bottom part by three circumferential slots 58. At one end of each of these slots 58, the top part is formed with outwardly projecting embossments 60, which may pass through some of the grooves 48 when the drive ring 38 is thrust over the tubular body of the casing 48. Then, when the drive ring 38 is rotated, it will be straddled by the embossments 60 and by the mounting lugs 52 so that it is held in a defined axial position on the casing 48, but is still rotatable relative to that casing. The angle of rotation may be limited by stops formed at the inner peripheral surface of the boss 46 and engaging into the slots 58. When the drive ring 38 is thrust over the tubular body of the casing 48, the top wall portions of that casing, delimited by the slots 58, may flex inwardly until the stops engage in the slots 58.

The casing 48 has a partition wall 62 (FIG. 4) that covers only two opposite 60°-sectors. Pressure plates 64 and seal plates 66 (made of foamed elastic material) are disposed at the bottom face of the bottom wall 62. A second closure member 68 is disposed underneath the seal plates 66.

Figure 4:
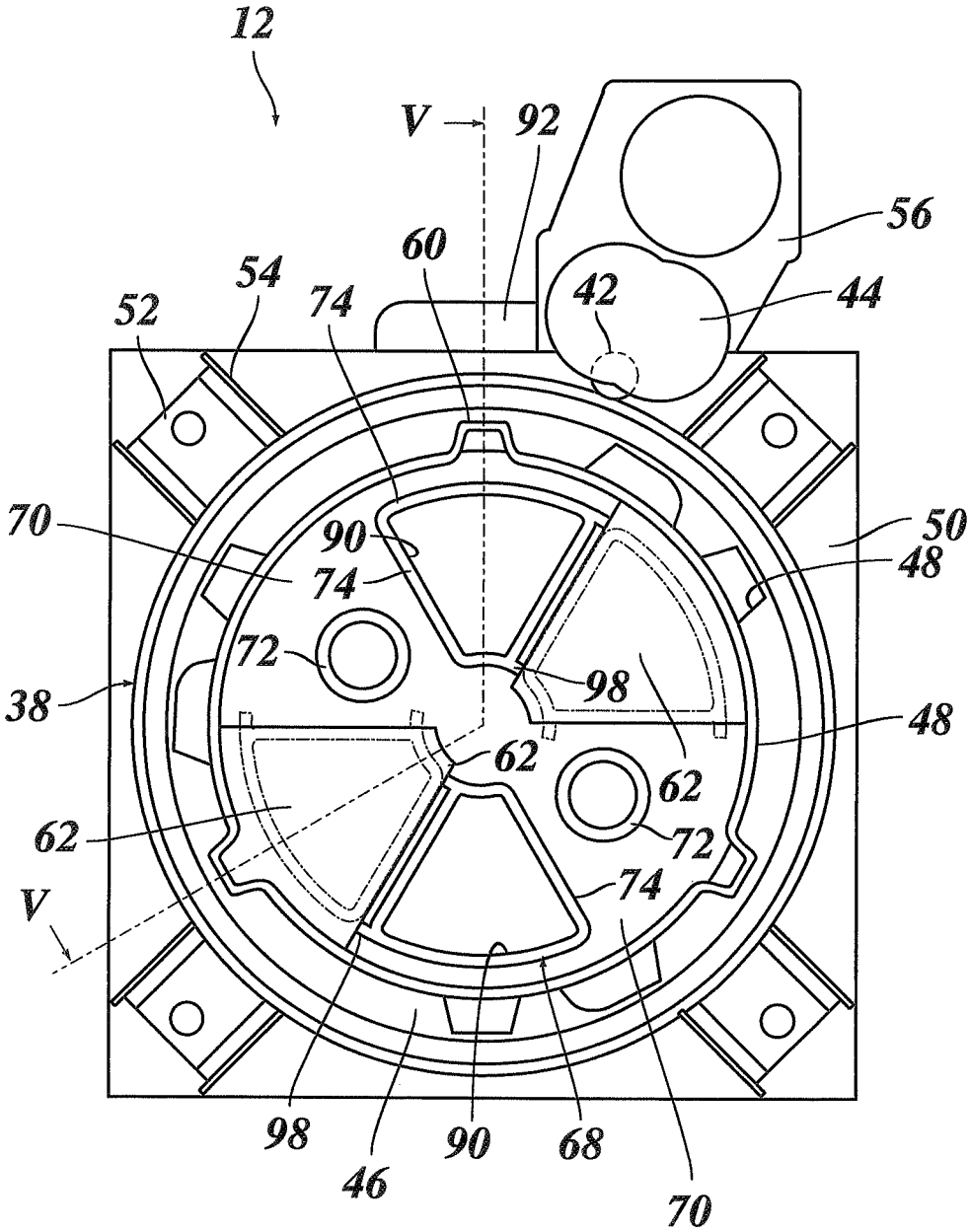
FIG. 4 is a top plan view of a first adapter unit of the device shown in FIG. 1.

As is best shown in FIG. 4, the second closure member 68 has a circular footprint which is again divided into six equi-angular sectors. Two diametrically opposite sectors (hidden behind the partition wall 62 in FIG. 4) are cut away. Two other sectors, which are also diametrically opposite to one another, serve as closure plates 70. Each of these closure plates carries an annular catch 72 on its top surface. Each of the remaining two sectors of the second closure member 68 is configured as a passage forming member 74. A vertical shaft 76 projects downwardly from the center of the closure member.

T base plate 50 (FIG. 3) has a central bore 78 which serves as a bearing for the shaft 76. Further, the base plate 50 defines a second refill opening 80 formed by two sector-shaped through-holes that are arranged symmetrically with respect to the bore 78.

A seal plate 82 is sandwiched between the second closure member 68 and the base plate 50 and is surrounded by a circular wall 84 that projects upwardly from the base plate 50. The seal plate 82 has openings congruent with the bore 78 and the second refill opening 80 in the base plate 50. The top surface of the seal plate 82 is covered by a slide foil, which reduces friction of the second closure member 68 when the closure plates 70 and passage forming elements 74 thereof slide over the seal.

The second refill opening 80 of the base plate 50 is surrounded by an elastic seal ring 86 that engages the bottom surface of the base plate 50. An elastic mounting fixture 88 projects downwardly from each corner of the base plate 54 and serves for elastically mounting the base plate 50 on a toner reservoir (not shown) of a printer or copier. The seal ring 86 is provided for sealing the gap between the base plate 50 and an inlet opening of the toner reservoir.

FIG. 4 is a top plan view of the second adapter unit 12. The second closure member 68 has been shown in an open position in which the passage defining members 74, each of which defines a sector-shaped passage 90, are flush with the first and second refill openings 22, 80 (not visible in FIG. 4). In this state, toner powder from the bottle 14 may drop through the first refill opening 22 in the bottom of the cap member 16, the openings 26 of the seal plate 24, the passages 90 of the passage forming elements 74 of the second closure member 68, the second refill opening 80 in the base plate 50, and the seal ring 86 into the toner reservoir. FIG. 4 further shows a wobbling device 92 which may be formed by a mass body driven for eccentric rotation by a motor. The wobbling device is attached to the mounting socket 56 for the motor drive 44. Thanks to the elastic mounting of the base plate 50 on the toner reservoir, the entire assembly of the second adapter unit 12, the first adapter unit 10 and the toner bottle 14 coupled together may be oscillated by means of the wobbling device 92 in order to promote complete discharge of the toner powder from the bottle 14.

Figure 5:
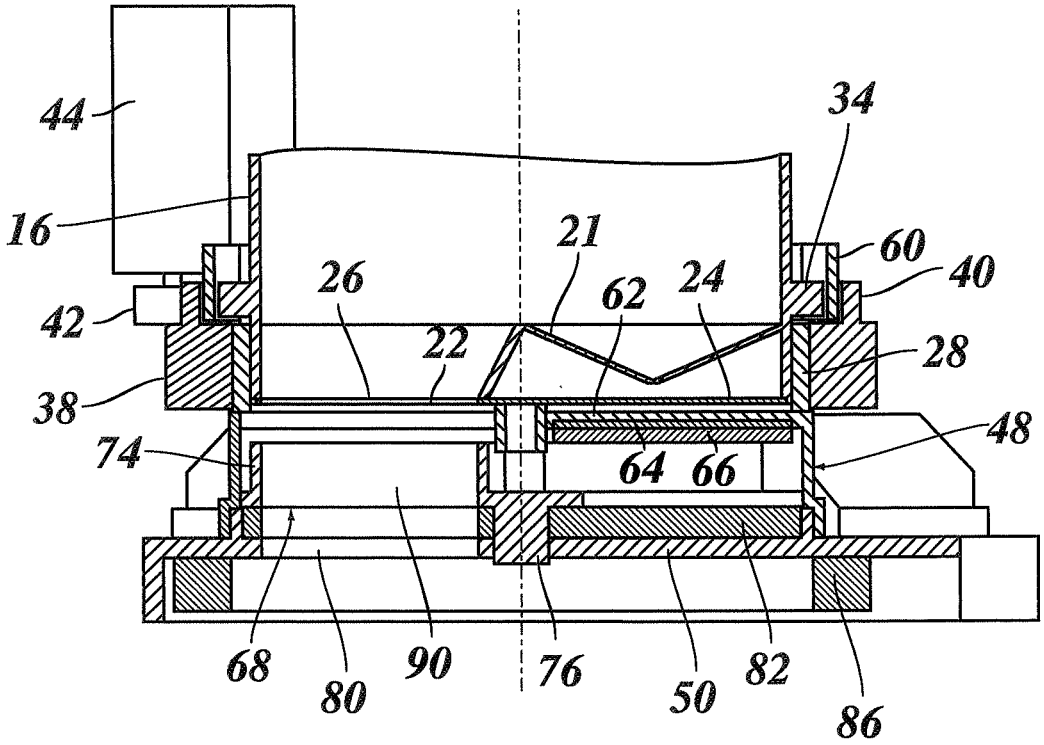
FIG. 5 is a sectional view taken along the line V-V in FIG. 4.

The open condition of the refill device has also been shown in a sectional view in FIG. 5. As can be seen in this sectional view, the bottom wall 21 of the cap member 16 is configured to form two funnels, which converge downwardly to the openings 26 in the seal plate 24 and delimit the first refill opening 22 (composed of two separate openings only one of which is visible in FIG. 5).

FIG. 5 also shows the cams 34 of the cap member 16 in engagement with grooves on the internal sides of the embossments 60 of the casing 48. The cams 34 prevent the cap member 16 from rotating.

When the toner bottle 14 has been emptied and is to be detached from the second adapter unit 12, the drive motor 44 is activated so that the pinion 42 drives the drive ring 38 to rotate by an angle of 60° in the clock-wise direction in FIG. 4. Since the cams 36 of the first closure member 28 engage the vertical grooves 48 of the drive ring 38, the sleeve first closure member participates in that rotation.

Figure 6:
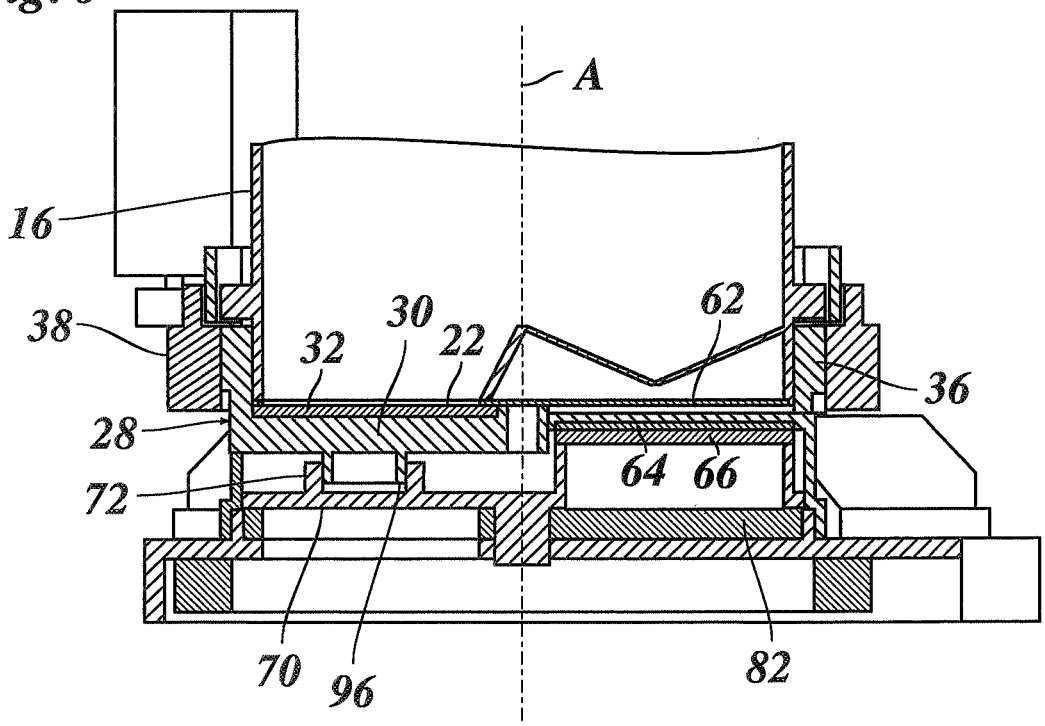
FIG. 6 is a sectional view similar to FIG. 5 for a closed position of the device.

As is shown in FIG. 6, the bottom wall 30 of the first closure member 28 has annular bosses 96, which project from the bottom surface of the bottom wall and engage in the annular catches 72 on the top surface of the second closure member 68. Thus, the first closure member 28 and the second closure member 68 are driven for joint rotation about a common axis of rotation A. As a result, the second closure member 68 is rotated into a position in which the passage forming elements 74 are angularly offset from the first and second refill openings 22 and 80 and the passages 90 are closed off by the sector-shaped partition wall 62 of the casing 48, as has been shown in phantom lines in FIG. 4.

FIG. 4 also shows that the passage forming element 74 has wall extensions 98, which project underneath the partition wall 62 already in the open position shown in FIG. 4, so that the passage forming elements will be smoothly guided into the position underneath the partition wall 62. During the rotation, the top edge of the peripheral walls of the passage forming elements 74 will slide along the seal plates 66 (FIGS. 5 and 6). In the position shown in FIG. 6, the passage 90 is completely sealed by the seal plate 66 at the top end and by the seal plate 82 at the bottom end, so that no toner dust may escape from the internal walls of the passage 90. Thus, the seal plates 66 and 82, together, define an accommodation space for the passage forming element 74.

FIG. 6 further shows the bottom wall 30 of the first closure member 28 with the slide foil 32 attached to the top surface thereof in a position in which it blocks the first refill opening 22 of the cap member 16. The drive ring 38 has reached a position in which the section taken along the line V-V in FIG. 4 passes through the cams 36 that project outwardly from the first closure member 28 and engage in the vertical grooves 48 at the inner periphery of the drive ring 38. In this position, the cams 36 are flush with the cams 34 of the cap member 16 and the vertical grooves 48 of the drive ring 38 are flush with the embossments 60 of the casing 48, so that the first adapter unit 10 comprising the cap member 16 and the first closure member 28 can be withdrawn upwardly from the second adapter unit 12 comprising the drive ring 38 and the casing 48.

Figure 7:
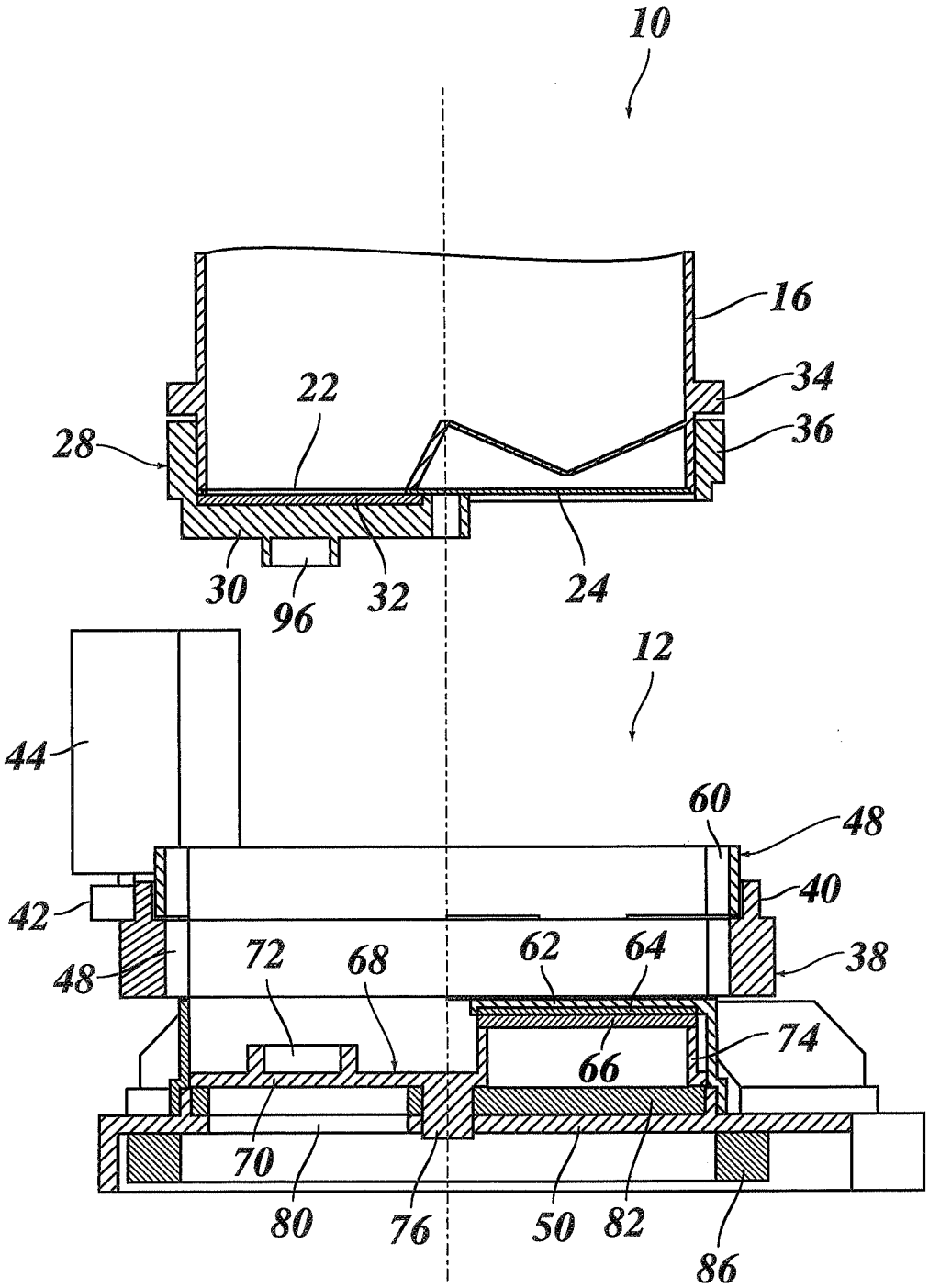
FIG. 7 is a sectional view of the device in a state where first and second adapter units are detached from one another.

FIG. 7 shows the first and second adapter units 10, 12 separated from one another. The bottom wall 30 of the first closure member 28 engages the seal plate 24 and tightly closes the first refill opening 22 so that any toner powder remaining in the bottle 14 cannot escape from the bottle.

The closure plates 70 of the second closure member 68 engage the seal plate 82 and tightly seal the second refill opening 80 in the base plate 50, so that the base plate 50 and the seal ring 86 reliably prevent toner from escaping from the toner reservoir.

The passage forming element 74 is tightly sandwiched between the seal plates 66 and 82, so that no toner powder may escape from the interior of the passage 90.

When a toner reservoir needs to be refilled another time, a new toner bottle with its first adapter unit 10 is mounted on the second adapter unit 12 by inserting the cams 36 and 34 into the embossments 60 and the grooves 48. Then, as soon as the drive ring 38 is rotated, it locks the sleeve 28 and therewith the entire first adapter unit 10 against vertical displacement relative to the second adapter unit 12. When the drive ring 38 is rotated further, the passage 90 of the passage forming element 74 again reaches a position where it connects the first and second refill openings 22 and 80, so that a toner refill path is established that is safely shielded against the environment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner refill device comprising:

a first adapter unit defining a first refill opening;

a first closure member attached to the first adapter unit and movable between a closed position in which the first closure member closes the first refill opening and an open position;

a second adapter unit defining a second refill opening; and a second closure member attached to the second adapter unit and movable between a closed position in which the second closure member closes the second refill opening and an open position, said second closure member having a passage forming element that connects the first and second refill openings when the second closure member is in the open position, wherein the second adapter unit defines an accommodation space for accommodating the passage forming element when the second closure member is in the closed position, wherein the first and second closure members are adapted to be coupled to one another for a joint movement relative to the first and second adapter units, and wherein the first and second closure members are rotatably supported in their respective adapter units, so as to be jointly rotatable about a common axis of rotation, and the second refill opening and the accommodation space are angularly offset from one another about said common axis of rotation.

2. The toner refill device according to claim 1, wherein the first adapter unit is configured as a cap of a toner bottle.

3. The toner refill device according to claim 1, wherein one of the first and second adapter units has elastic fixtures for being elastically mounted on a toner reservoir to be refilled, and an elastic seal ring surrounding the second refill opening for sealing a gap between said one of the first and second adapter units and the toner reservoir.

4. The toner refill device according to claim 3, wherein one of the first and second adapter units has a power-driven wobbling device causing the assembly of the coupled first and second adapter units and the toner bottle to oscillate.

5. The toner refill device according to claim 1, further comprising a motor drive unit controlling the joint rotation of the first and second closure members.

6. The toner refill device according to claim 1, wherein the first and second adapter units are adapted to be locked to one another against relative displacement in a direction in parallel with said common axis of rotation when the first and second closure members are coupled to one another.

7. The toner refill device according to claim 1, wherein the first closure member has outwardly projecting cams, and the second adapter unit comprises a rotatable drive ring having axial grooves in an internal peripheral surface thereof, said grooves being arranged for accommodating said cams.

8. The toner refill device according to claim 7, wherein a body of the first adapter unit has outwardly projecting cams in positions coinciding with the positions of the cams of the first closure member when the latter is in the closed position, and a casing of the second adapter unit has vertical grooves permitting the cams of the first closure member to pass through and to accommodate the cams of the body of the first adapter unit.

9. The toner refill device according to claim 1, wherein the first refill opening is formed by two through-holes, each of the two through-holes being shaped as a sector of a circle with a central angle of 60°, the two through-holes being arranged diametrically opposite to one another with respect to the axis of rotation, and wherein the passage forming element and the second refill opening have shapes corresponding to that of the first refill opening.

10. The toner refill device according to claim 9, wherein the first closure member has a bottom wall configured to close the first refill opening, said bottom wall having a boss projecting towards the second closure member, and the second closure member is configured as a plate that has, in positions angularly offset from the passage forming element, a catch engageable by said boss.

11. The toner refill device according to claim 9, wherein the second adapter unit has a base plate defining the second refill opening and rotatably supporting the second closure member, the second adapter unit further having a partition wall axially spaced apart from the base plate and having a shape corresponding to two diametrically opposite sectors of a circle, said partition wall, together with the base plate, defining said accommodation space for the passage forming element.

12. The toner refill device according to claim 11, wherein seal plates are attached to the surfaces of the partition wall and the base plate that face towards one another, and the passage forming element is configured as an upright wall extending between said seal plates, said upright wall having wall extensions that project into said accommodation space when the second closure member is in the open position, for guiding the passage forming element into the accommodation space when the second closure member is rotated into the closed position.

* * * * *